United States Patent [19]

Newton et al.

[11] Patent Number: 4,608,026

[45] Date of Patent: Aug. 26, 1986

[54] FIGURE WHEREIN MANIPULATION OF ONE LIMB CAUSES MOTION OF ANOTHER

[75] Inventors: Jean M. Newton, Park Hills, Ky.; William N. Smith, Batavia, Ohio

[73] Assignee: CPG Products Corp., Minneapolis, Minn.

[21] Appl. No.: 699,621

[22] Filed: Feb. 8, 1985

[51] Int. Cl.[4] ..... A63H 3/20

[52] U.S. Cl. ..... 446/330; 446/334; 446/376

[58] Field of Search ..... 446/156, 158, 159, 330, 446/333–336, 340, 341, 352–355, 358, 359, 365

[56] References Cited

U.S. PATENT DOCUMENTS

| | | | |
|---|---|---|---|
| 140,259 | 6/1873 | Eaton | 446/158 |
| 207,188 | 8/1878 | Martin | 446/158 |
| 1,359,778 | 11/1920 | Zimmerman | 446/330 |
| 1,800,775 | 4/1931 | Bostwick | 446/336 |
| 3,835,581 | 9/1974 | Grieder | 446/158 |

*Primary Examiner*—F. Barry Shay

*Attorney, Agent, or Firm*—Gene O. Enockson; L. MeRoy Lillehaugen; Stuart R. Peterson

[57] ABSTRACT

The toy action figure includes a body having one leg mounted for rocking movement toward and away from its other leg. The figure also includes one arm mounted for swinging movement about a generally vertical axis provided by a ball member on said arm and a ball cup integral with the figure's body. A motion-converting mechanism is contained within the body which mechanism comprises an actuating lever which is rocked when said one leg is rocked. The actuating lever includes a triangularly configured cam at its upper end having an angled cam edge which engages against an edge on a panel. The panel is integral with a transmission lever that constitutes an inverted T-shaped member and which pivots abouts its lower T-shaped end when the cam edge acts against the panel edge so as to cause a generally vertical pin of the upper end of the transmission lever to force in an angular direction a lever arm integral with a ball member on the arm to be swung. By means of a hairpin spring, the motion-converting mechanism, together with the actuated leg and the actuated arm, is returned to its inactive condition or state.

10 Claims, 10 Drawing Figures

FIGURE WHEREIN MANIPULATION OF ONE LIMB CAUSES MOTION OF ANOTHER

BACKGROUND OF THE INVENTION

This invention relates generally to toy figures having movable limbs, and pertains more particularly to an action figure in which the manual rocking of one leg in a direction toward the other leg produces an arm movement about a single generally vertical axis.

SUMMARY OF THE INVENTION

An object of the present invention is to provide a toy action figure that will possess a sufficient amount of mystique and intrigue so as to retain the interest of a child over a relatively long period of time. In this regard, it is within the purview of the invention to have the toy action figure resemble a well-known comic character. More specifically, an aim of the invention is to have the leg at one side of the toy figure rockable in a direction toward the other leg so as to produce a swinging motion of the arm at the same side about a vertical axis. In this way, the arm at the same side is moved more rearwardly relative to the figure's body.

Another object of the invention is to provide a toy action figure having a motion transmitting mechanism that is especially adapted to convert the rocking motion of one leg to the above-referred to arm motion. In this regard, an aim of the invention is to house the motion converting mechanism entirely within the toy figure's upper torso so as not to detract from the outer appearance of the toy figure.

Yet another object is to provide a spring return action so that the leg that is manipulated and the arm that moves in response to the leg manipulation are both returned to their initial or unactuated positions.

The invention has for still another object the provision of a motion-converting mechanism that can be fabricated so that it occupies relatively little space, thereby rendering the mechanism suitable for complete containment within the hollow upper torso forming a part of the toy action figure.

Another object of the invention is to provide a toy action figure in which no additional member is required for attaining the desired arm movement. In this regard, an aim of the invention is to use one of the legs, which is a natural limb, to effect the motion of another limb, namely an arm of the same side as the one leg, so that the figure can be made to resemble a comic character.

Briefly, our invention contemplates the use of a hollow upper torso in which the motion converting mechanism is completely contained. The figure also has a lower torso to which the two legs are attached. One leg is mounted for rocking movement relative to the other leg. Also, one arm, which is on the same side of the toy figure as the leg to be manipulated, is mounted for swinging movement about the generally vertical axis provided by a ball and socket-type shoulder mounting. The mechanism for converting the rocking leg movement to the swinging arm movement includes an actuating lever having a triangular cam located at its upper end, the lower end providing the rocking axis for the leg to be manipulated. The triangular cam has an angled edge that acts against a vertical follower edge on a panel integral with an inverted T-shape transmission lever. The oppositely directed horizontal leg portions of the transmission lever are journaled for pivotal movement, whereas the upper end portion of the transmission lever constitutes a pin that projects upwardly into a slot formed in a lever arm that is integral with the ball member that is nested within an arm cup or socket. The ball member and the arm cup provide the vertical axis about which the actuated arm swings, the arm cup having a horizontal slot therein via which the slotted arm lever extends so as to enable the actuated arm to swing about the vertical axis. By means of a hairpin spring which is engaged with the panel having the follower edge thereon returns the entire motion converting mechanism to its initial or unactuated state, and at the same time returns the leg and arm back to their unactuated positions.

DESCRIPTION OF THE PREFERRED EMBODIMENT

Figure 9:
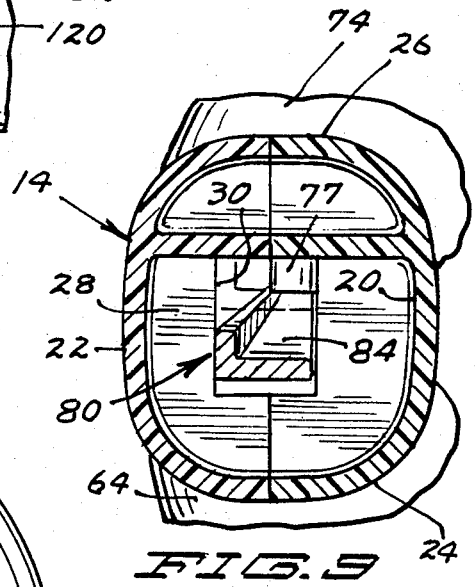
FIG. 9 is a horizontal sectional view taken in the direction of lines 9—9 of FIGS. 3 and 7.

Our invention is illustrated by way of a plastic toy action figure denoted generally by the reference numeral 10. The toy figure 10 includes a head 12, a body 14 having an upper torso 16 and a lower torso 18. The upper torso 16 has a front wall 20, a rear wall 22, a right sidewall 24, a left sidewall 26, as well as a bottom wall 28. The bottom wall 28 has formed therein during the molding of the plastic toy action figure 10 a transverse slot 30, as best understood from FIG. 9.

Insofar as the lower torso 18 is concerned, it will be discerned that the top thereof constitutes the above-mentioned bottom wall 28 belonging to the upper torso 16. Additionally, the lower torso 18 is formed with sidewalls 32 and 34, a curved bottom wall 36, and a flange or partition 38 extending upwardly from the bottom wall 36 to form a notch 40.

Figure 10:
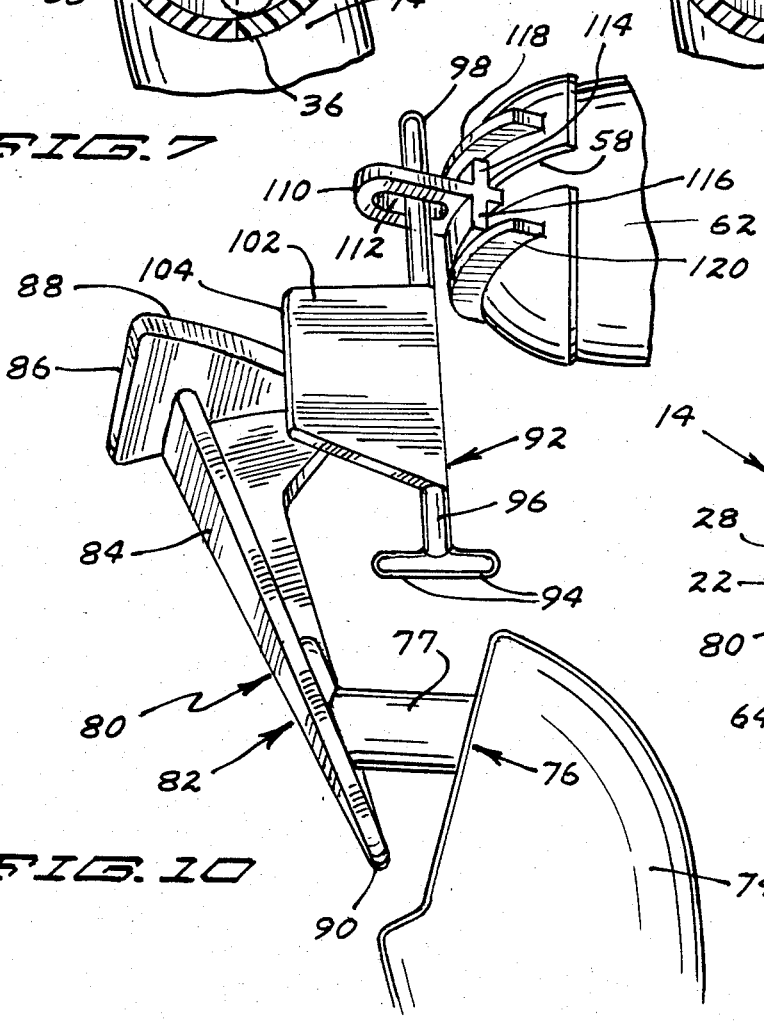
FIG. 10 is a perspective view of the motion-converting mechanism divorced from the toy action figure.

The toy action figure 10 has a right shoulder labeled 42 and a left shoulder labeled 44. Associated with the right shoulder 42 is a right arm 46. The right arm 46 is attached to the upper torso 16 by reason of a mounting unit 48 which includes a sleeve 52 that is fixedly attached to the upper end of the right arm 46. The sleeve 52 is journaled for pivotal movement in an aperture 54 formed in the right sidewall 24 of the upper torso 16. All that is desired, insofar as the right arm 46 is concerned, is to have the right arm 46 mounted for swinging movement forwardly and rearwardly about the horizontal axis provided by the sleeve 52. The posing of the right arm 46 at various angles is done directly by the child so there is no need for any motion converting mechanism.

The left shoulder 44 is formed by means of a ball cup or socket 56 having a horizontal slot 58 therein, the ball cup 56 being integral with the left sidewall 26 of the upper torso 16. The toy figure 10 also has a left arm 60 which has a ball member 62 attached to its upper end. Although not illustrated, the attachment of the upper end of the upper end of the arm 60 to the ball member 62 can correspond to the attachment of the right arm 46 in that a mounting unit like the unit 48 can be employed, thereby affording greater posing capability since the arm 60 could under such conditions be pre-positioned and then actuated in a fashion yet to be described. More will be said presently concerning the function of the ball cup 56 and the ball member 62 nestingly received therein.

At this time, the right leg, which is identified by the reference numeral 64, will be described. A mounting unit for the right leg 64, and which is assigned the reference numeral 66, includes a head 68 and a sleeve 70 extending inwardly through an aperture 72 provided in the right sidewall 32 of the lower torso 18.

The left leg, which carries the reference numeral 74, is mounted to the left sidewall 34 by means of a mounting unit 76 which includes a sleeve 77. The left leg 74 has its upper or thigh portion connected directly to the outer end of the sleeve 77 of the mounting unit 76. The detailed manner in which the left leg 74 is fixedly attached to the outer end of the sleeve 76 need not be described; nonetheless, it should be recognized that the attachment is of a fixed nature so that the mounting unit 76 is rockable with the left leg 74.

Turning now to a motion-converting mechanism indicated generally by the reference numeral 80, it will be discerned that the mechanism 80 comprises an actuating lever 82 having a shank 84 with a triangularly shaped cam 86 at the upper end thereof, the cam 86 having an angled edge or surface 88 thereon. The lower end of the shank 84 is rounded, as indicated by the numeral 90, so as to provide a rocking axis for the lever 82.

Additionally, the motion-converting mechanism 80 includes a transmission lever 92 which is T-shaped, more specifically, possessing an inverted T-shaped configuration. The lower end of the lever 92, being T-shaped, has transversely extending legs 94 and an upwardly directed leg 96 which is perpendicular to the transverse legs 94. The upper end portion of the lever 92 constitutes a pin 98. The legs 94 are journaled for pivotal movement in a bearing 100 integral with the left sidewall 26 of the upper torso 18. A panel 102 is integral with the lever 92, the panel 102 extending from an intermediate portion of the lever 92, so as to provide a generally vertical edge 104 that is engaged by the previously mentioned edge 88 on the triangularly shaped cam 86. Thus, the panel 102 functions as a cam follower due to the forceful engagement between it and the cam 86, as will be better understood hereinafter. Due to the forceful engagement, though, a horizontal rib or flange 106 on the sidewall 26 provides an edge 108 against which the shank 96 bears as the lever 92 is moved from the position best viewed in FIG. 7 to that depicted in FIG. 8. In other words, the rib 106 absorbs the lateral thrust imposed on the transmission lever 92 by the cam 86. It has already been mentioned that this will be better understood later on.

Continuing with the description of the motion-converting mechanism 80, the mechanism 80 includes a lever arm 110 having a slot 112 therein. The lever arm 110 is fixedly attached to the ball member 62 and extends inwardly through the earlier-mentioned slot 58 in the ball cup 56. The lever arm 110 has integral therewith an upwardly directed curved flange 114 and a downwardly directed curved flange 116 which impart rigidity to the lever arm 110 and which also serve as a means for guiding the lever arm 110 in the needed curvilinear or angular path it should follow in moving between the arm positions shown in FIGS. 5 and 6. There is also an upper horizontal flange 118 and a lower horizontal flange 120, these flanges 118, 120 being integral with the inner side of the ball cup or socket 56. The flanges 118 and 120 can, if desired, guide to some degree the pin 98 at the upper end of the transmission lever 92.

Although the manner in which our toy action figure 10 is manipulated has not yet been described, it can be stated that it is important to have the motion transmitting mechanism 80, as well as the left arm 60 and the left leg 74, returned to its natural or unactuated position. Therefore, attention is drawn to a hairpin spring 122 comprised of several turns or convolutions 124, a leg 126 extending in one direction from the turns or convolutions 124 and having a right angle end portion 128 thereon which reactively engages the inner side of the front wall 20, whereas a second leg 130 extends from the turns or convolutions 124 and has a U-shaped end 132 thereon so as to hook over the upper edge of the panel 102, as perhaps best viewed in FIGS. 7 and 8.

Figure 2:
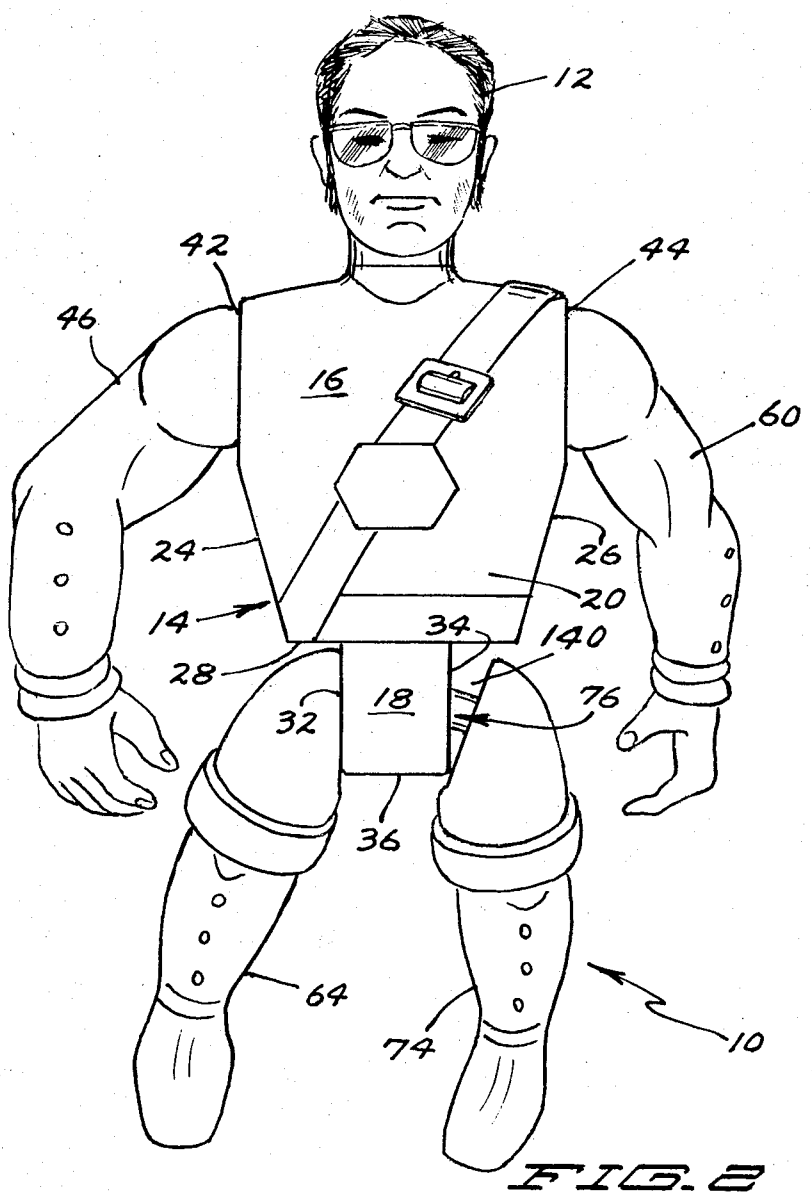
FIG. 2 is a view similar to FIG. 1 but with the left leg rocked in the direction of the right leg so as to cause the left arm to move rearwardly relative to the body of the action figure, the position of the left arm corresponding to the phantom position thereof in FIG. 1.
Figure 1:
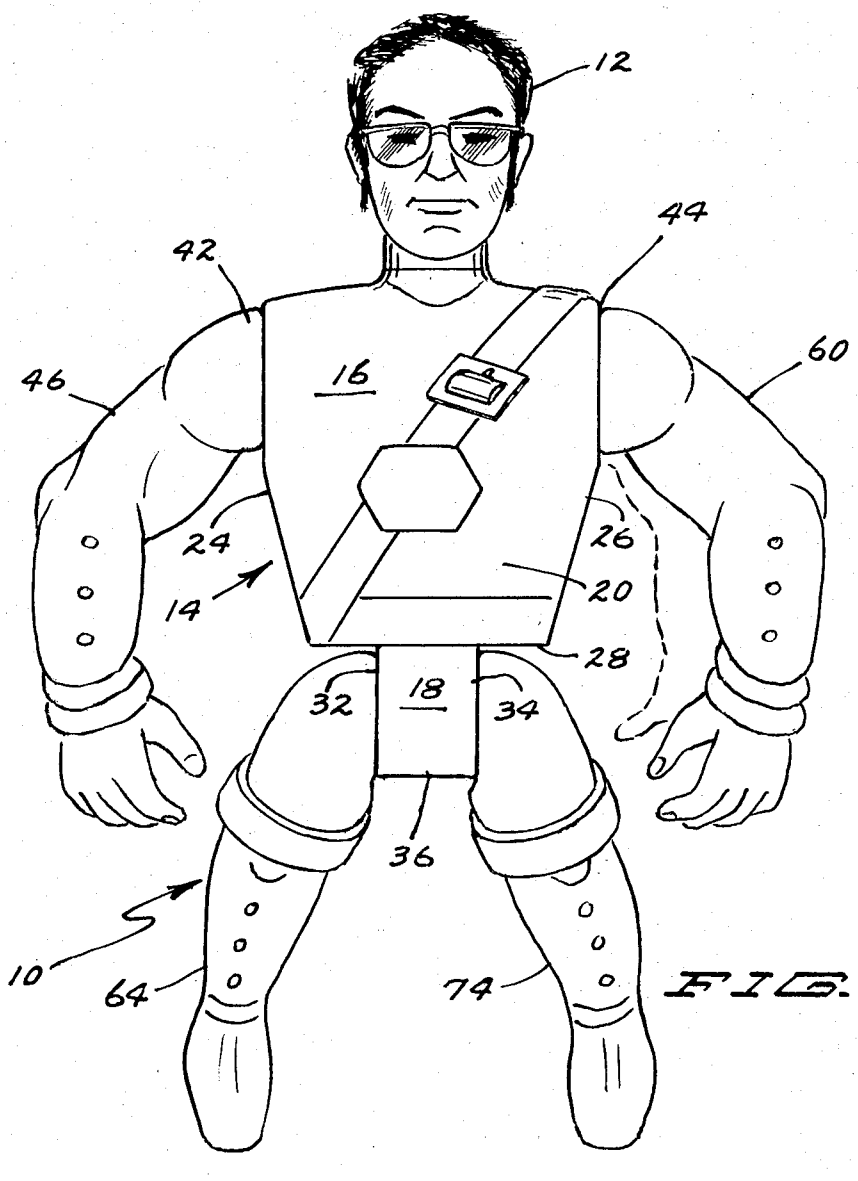
FIG. 1 is a front elevational view of one form that our toy action figure may assume, the phantom position of the left arm depicting the actuated condition thereof.
Figure 3:
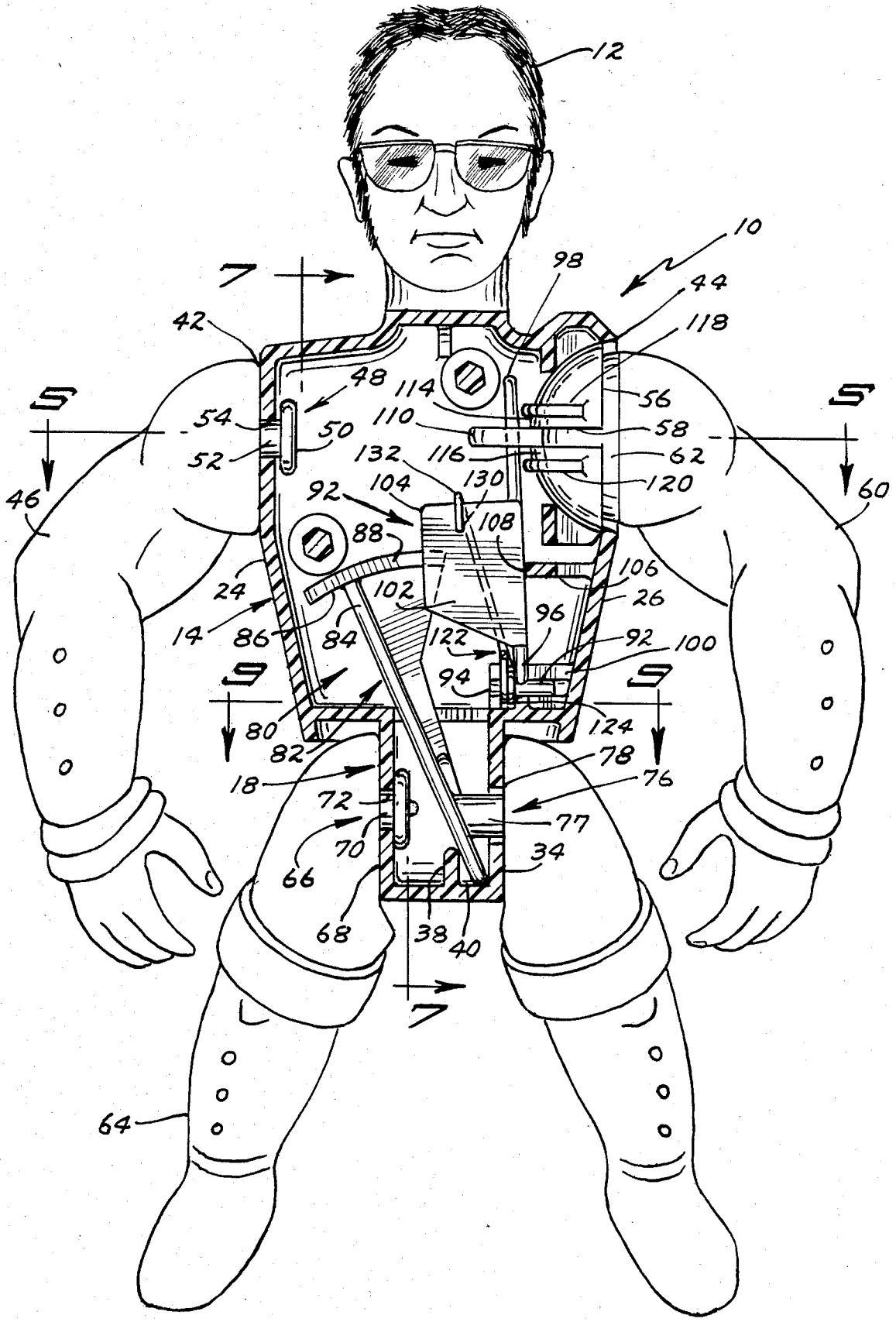
FIG. 3 is an enlarged front elevational view corresponding to FIG. 1 but with the chest portion of the hollow upper torso removed so as to expose to view the motion-converting mechanism contained in this torso.
Figure 4:
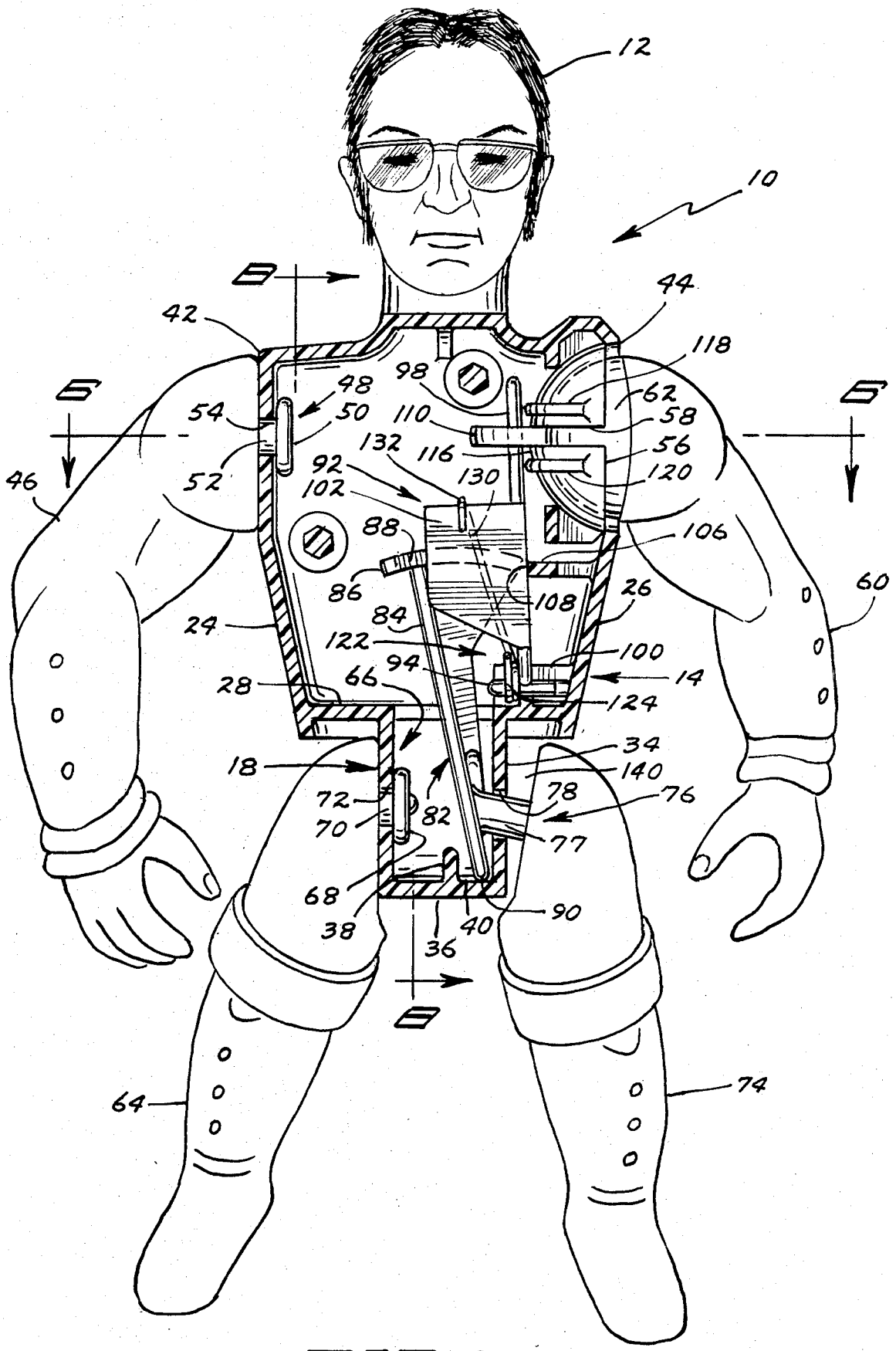
FIG. 4 is a view corresponding to FIG. 2 but with the chest portion of the upper hollow torso removed as in FIG. 3.

Insofar as the operation of the toy action figure 10 is concerned, the child need only rock the left leg 74 from the position in which it appears in FIGS. 1 and 3 into the position in which it appears in FIGS. 2 and 4. Whereas the upper or thigh portion of the left leg 74 engages the left sidewall 34 of the lower torso 18 in FIGS. 1 and 3, the manipulation of the left leg 74 toward the right leg 64 to produce the actuated or angled condition of the left leg 74 appearing in FIGS. 2 and 4 produces an angled gap denoted by the reference numeral 140 in these figures.

Hence, the lower rounded end 90 on the actuating lever 82 serves as a fulcrum so that the actuating lever 82 swings in a vertical plane from the position in which it appears in FIG. 3 to that in which it appears in FIG. 4. The actuating lever 82 is constrained to traverse an angular movement in a slightly canted plane by reason of the slot 30 formed in the bottom wall 28 of the upper torso 16, which, as previously explained serves as the top wall for the lower torso 18.

Owing to the constraint imposed on the actuating lever 82 as it is swung or rocked between the position shown in FIG. 3 and the position shown in FIG. 4, the triangular cam 86 at the upper end of the actuating lever 82 has its angled cam edge 88 forced against the edge 104 provided by the panel 102, the panel 102 in this way functioning as a cam follower. As a result, a camming action is exerted against the panel 102 so as to force the panel 102 from the position best seen in FIG. 5 (and FIG. 7) to the position best viewed in FIG. 6 (and in FIG. 8). This action is perhaps even more readily understandable from FIG. 10, for the motion transmitting mechanism 80 has been pictured in a disassociated manner from the body 14.

Because the lower transverse legs 94 belonging to the transmission lever 92 are journaled for pivotal movement in the bearing 100, as best seen in FIGS. 3 and 4, the upper end, which constitutes the pin 98, bears against one side of the slot 112 in the lever arm 110. Since the lever arm 110 is integral with the ball member 62, the left arm 60 is swung rearwardly from the position shown in FIG. 5 to the more rearwardly disposed position appearing in FIG. 6. Of course, this is done by reason of the fact that the ball member 62 is constrained for movement about a vertical axis because of its nested relationship with the ball cup or socket 56.

As the pin 98 is forced forwardly by virtue of the camming action provided by the triangular cam 86 against the panel of the transmission lever 92, the pin 98 can move within the slot 112. During the angular movement of the pin 98 from the position depicted in FIG. 7 to the position depicted in FIG. 8, the pin 98 bears against the forward edge of the slot 112.

Figure 5:
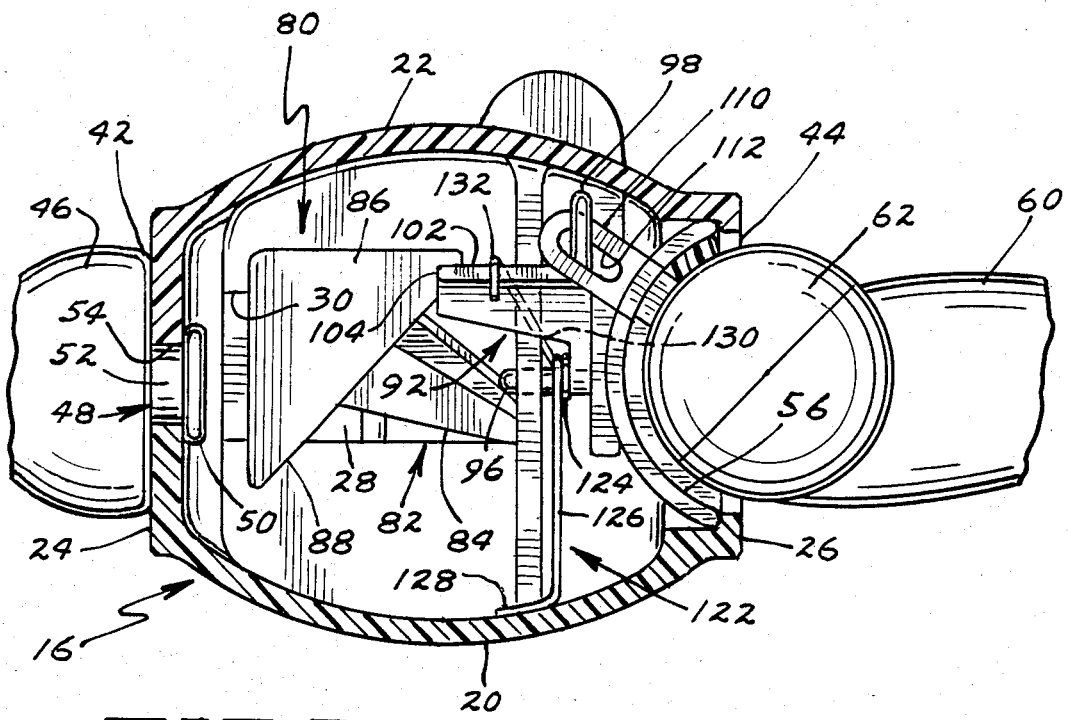
FIG. 5 is a horizontal sectional view taken in the direction of line 5—5 of FIG. 3.
Figure 6:
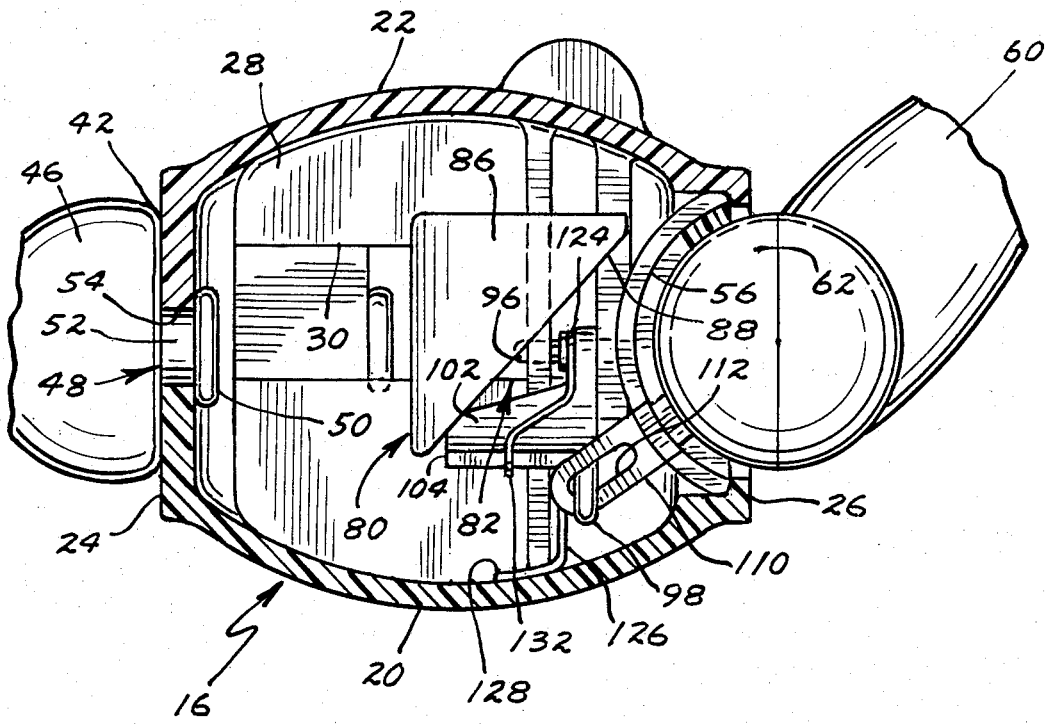
FIG. 6 is a horizontal sectional view taken in the direction of line 6—6 of FIG. 4.
Figure 7:
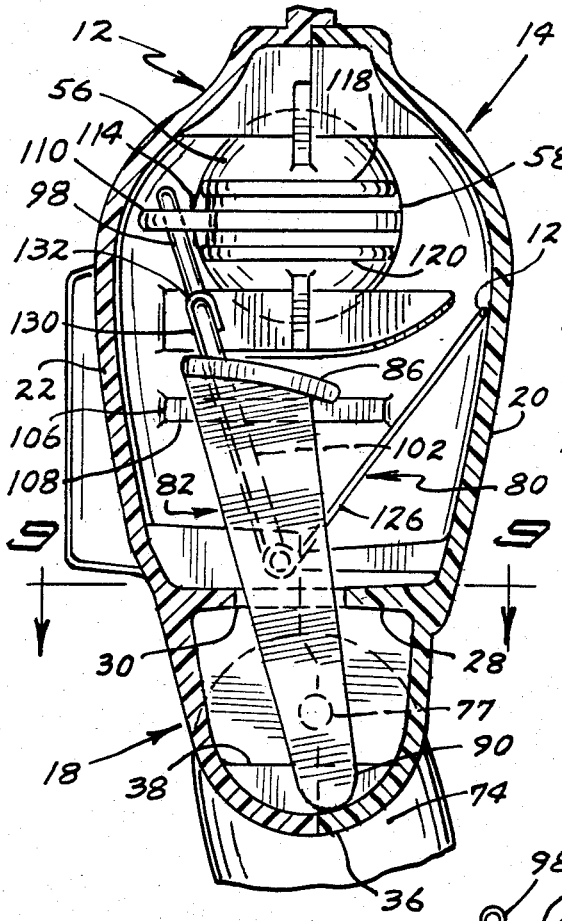
FIG. 7 is a vertical sectional view taken in the direction of line 7—7 of FIG. 3.
Figure 8:
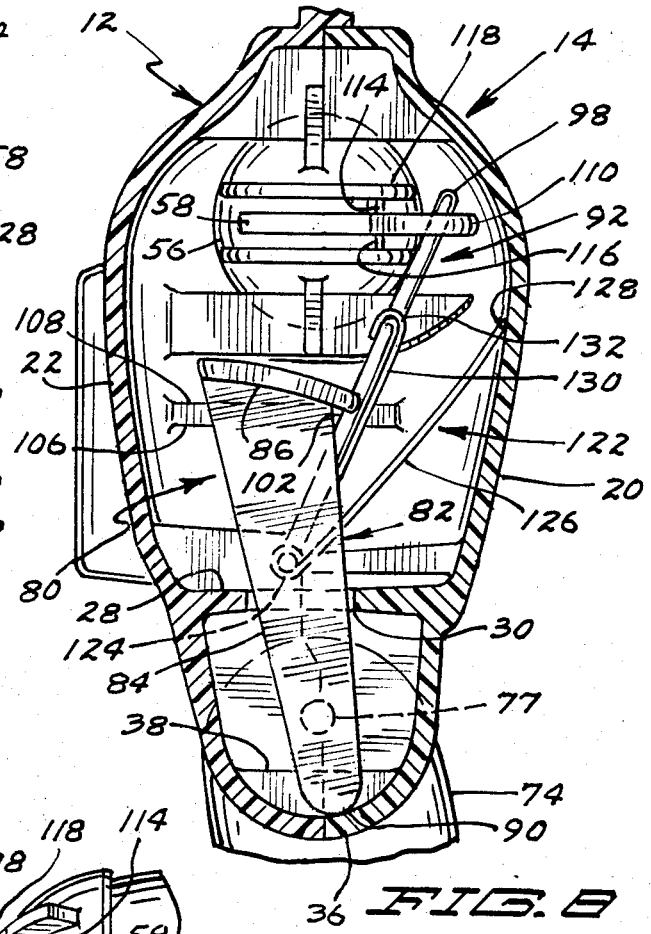
FIG. 8 is a vertical sectional view taken in the direction of line 8—8 of FIG. 4.

The above action, being that the lever arm 110 is integral with the ball member 62, causes the left arm 60 to swing from the laterally disposed position of FIG. 5 to the more rearwardly disposed position of FIG. 6. Stated somewhat differently, the left arm 60 moves rearwardly relative to the upper torso 16 when the left leg 74 is thrust toward the right leg 64. As this happens, the hairpin spring 122 has its legs 122 and 126 forced into a more acute angle due to the movement of the transmission lever 92 from the angular position in which it is shown in FIG. 7 to the angular position in which it appears in FIG. 8. Thus, spring energy is stored by virtue of the flexing of the leg 130 relative to the leg 126. When the child releases his or her grasp of the left leg 74, then the stored spring energy is released, returning the panel 102 from the position it has been actuated into as far as FIG. 8 is concerned back to the position in which it appears in FIG. 7. The edge 104 on the panel 102 now acts in a reverse direction against the angled cam edge 88 on the cam 86 so as to return the actuating lever 82 to its original or unactuated position. In other words, the actuating lever 82 is shifted back from the actuated position shown in FIG. 4 to the unactuated position shown in FIG. 3.

Of course, the left leg 74 is fixedly attached to the lower end of the actuating lever 82 so it is rocked back to its initial or unactuated position, this position being illustrated in FIGS. 1 and 3.

Due to the fact that the panel 102 is an integral part of the transmission lever 92, the reverse movement of the pin 98, which is also an integral part of the transmission lever 92, causes the pin 98 to act against the other side of the slot 112 so as to return the lever arm 110 to its unactuated position, the unactuated position of the lever arm 110 being best viewed in FIG. 5. Since the lever arm 110 is fixedly attached to the ball member 62, the movement of the actuating lever 110 from the actuated position thereof in FIG. 6 back to the unactuated position of FIG. 5 causes the left arm 60 to move forwardly once again.

Consequently, it should be appreciated that both limbs 60 and 74 are returned to their initial or unactuated positions, all as determined by the return of the motion-converting mechanism 80 to its unactuated condition by means of energy released from the hairpin spring 122.

We claim:

1. A toy action figure comprising hollow upper and lower torsos, first and second legs, first means mounting said first leg to said lower torso, second means mounting said second leg to said lower torso for rocking movement toward and away from said first leg, first and second arms, third means mounting said first arm to said upper torso, fourth means mounting said second arm to said upper torso for swinging movement relative thereto about a generally vertical axis, said second leg and said second arm being on the same side of said figure and a motion-converting mechanism connected to said second mounting means and to said fourth mounting means for converting the rocking movement of said second leg to the swinging movement of said second arm, said motion-converting mechanism including an actuating lever connected to said second leg adjacent one end and having an angled cam edge adjacent its other end, a transmission lever movably mounted in said figure having one end disposed for rocking movement, a pin adjacent its other end and an intermediate cam follower edge acted upon by said angled cam edge, and a lever arm on said second arm having a slot therein, said pin extending into said slot to cause said second arm to swing about the said generally vertical axis upon the carrying out of said rocking movement by said second leg.

2. A toy action figure in accordance with claim 1 in which said fourth mounting means includes a ball member on said second arm, said lever arm extending from said ball member and a ball cup on said upper torso receiving said ball member, said ball cup having a horizontal slot through which said lever arm extends.

3. A toy action figure in accordance with claim 2 including flange means on said lever arm, said flange means being adjacent the opposite side of said ball cup from said ball member.

4. A toy action figure in accordance with claim 3 including flange means on said ball cup, said last-mentioned flange means being on the opposite side of said ball cup from said ball member.

5. A toy action figure comprising a hollow body having limbs mounted thereon, a first said limb mounted for rocking movement relative to said body, a second said limb mounted for swinging movement relative to said body, an actuating lever attached to the mounted end of said first limb and disposed for rocking movement when said first limb movement is carried out, a lever arm attached to the mounted end of said second limb and disposed for swinging movement with said second limb, said lever arm having a slot therein, a cam integral with said actuating lever, said cam having an angled cam edge, a cam follower engagable by said angled cam edge, and means connecting said cam follower to said lever arm including a transmission lever mounted for pivotal movement at one end and having its other end received in said slot for causing said second limb to swing when said first limb is rocked, said cam follower being integral with said transmission lever.

6. A toy action figure in accordance with claim 5 in which said transmission lever is T-shaped at said one end, and means within said body mounting the T-shaped end of said transmission lever for pivotal movement when said cam follower is acted upon by said angled edge.

7. A toy action figure in accordance with claim 6 in which said cam follower includes a panel projecting from an intermediate portion of said transmission lever, said panel providing an edge for engagement by said angled edge.

8. A toy action figure in accordance with claim 7 including a rib projecting inwardly from one side of said hollow body, said rib providing an edge against which said transmission lever bears when said panel edge is acted upon by said angled cam edge.

9. A toy action figure comprising a torso, first and second limbs, one of said limbs constituting a leg and the other of said limbs constituting an arm, first means mounting said first limb to said torso at one location for rocking movement in a generally transverse vertical plane relative to said torso, second means mounting said second limb to said torso at a second location spaced from said first location for swinging movement about a generally vertical axis in a fore and aft direction relative to said torso, and a motion-converting mechanism including an actuating lever having one end integral with said first means and rockable with said first limb in the same transverse vertical plane as said first limb, a transmission lever mounted within said torso for pivotal fore and aft movement in a generally vertical plane which is perpendicular to said transverse plane, said actuating lever including a cam member having an edge angling forwardly and rearwardly relative to said actuating lever and also relative to said transverse vertical plane, said transmission lever having a vertical edge engageable by said angled edge to cause said transmission lever to pivot, and means interconnecting the other end of said transmission lever to said other limb to produce said swinging movement of said other limb.

10. A toy action figure in accordance with claim 9 in which said interconnecting means includes a lever arm on said second limb projecting into said torso, said lever arm having an opening therein into which said other end of the transmission lever extends to produce said swinging movement of said other limb.

* * * * *